US005857544A

United States Patent [19]

Del Sole

[11] Patent Number: 5,857,544

[45] Date of Patent: Jan. 12, 1999

[54] INDEPENDENT MOBILE WORK LADDER SUPPORT STAND

[76] Inventor: Robert Del Sole, 86 Valley Rd., Larchmont, N.Y. 10538

[21] Appl. No.: 897,972

[22] Filed: Jul. 21, 1997

[51] Int. Cl.[6] ..... E06C 1/14

[52] U.S. Cl. ..... 182/180.3; 182/180.2

[58] Field of Search ..... 182/180.1, 180.2, 182/180.3

[56] References Cited

U.S. PATENT DOCUMENTS

| | | | |
|---|---|---|---|
| 69,049 | 9/1867 | Turner | 182/180.2 |
| 141,126 | 7/1873 | Eason . | |
| 657,932 | 9/1900 | Gardner | 182/180.3 |
| 1,381,397 | 6/1921 | Boiles . | |

*Primary Examiner*—Alvin Chin-Shue
*Attorney, Agent, or Firm*—Richard A Joel, Esq

[57] ABSTRACT

A ladder support for a parallel rail extension ladder to be used as a step ladder in situations where there is no vertical support available for the upper ends of the rails. The support comprises a base frame piece running perpendicular to the rails of the ladder. The base extends left and right and has terminal pieces that run perpendicular with a cross bar at each end. Running perpendicular and intersecting the central portion of the cross bar is a support member parallel with the bottom rail and running around the upper end and perpendicular to the base section. Connected intermediately is the top portion of the adjustable support including the vertical support piece which is hinged to the cross member at one end and the cross member of the parallel. At the top of the parallel rails is a support bar running perpendicular to the support piece and having lateral pieces at the end thereof which serve to prevent the ladder from shifting left or right. The support member is adjustable in length to be able to adjust the incline of the ladder from vertical towards horizontal.

7 Claims, 3 Drawing Sheets

INDEPENDENT MOBILE WORK LADDER SUPPORT STAND

BACKGROUND OF THE INVENTION

1. Field of the Invention

The present invention relates generally to ladders and more specifically to auxiliary stands for utilization with extension ladders in situations where it is not possible to rest the upper end of the ladder against a vertical support. It is utilized in situations where the employment of a stepladder is not suitable or in situations where it is more convenient, economic and efficient to use only an extension ladder and not to have to deal with and handle both an extension ladder and/or a stepladder which may or may not be of the appropriate height for the job being undertaken.

As is known, extension ladders are generally comprised of an upper and lower section at least, and possibly more. Each section is comprised of a pair generally parallel rails with the usual rungs for stepping on extending between the rails. The upper and lower ladder sections are slidably mounted with respect to each other. The upper ladder section is extendible with respect to the lower ladder section. The upper section can be extended to varying lengths to provide additional height when used, and then retracted and closed for storage when not in use.

The other type of common ladder is referred to as a stepladder which comprises ladder sections with generally parallel rails with a plurality of spaced rungs extending between them. An opposing frame which may be just a frame or a mirror image of the first ladder section has an upper end hingedly attached to the upper end of the first ladder section. In the erected condition it extends downwardly and outwardly therefrom. A pair of foldable braces or arms are usually hingedly connected at intermediate points of the ladder sections so as to hold the ladder sections in a predetermined angular relationship to each other so that, as is known, when the stepladder is erected it is generally in an A configuration. Most stepladders have no means of adjusting the height and are of limited utility, particularly in the case where they must be erected on an uneven substrate or when the height of the area to be reached is recessed away from the base of the object of which it is desired to access the upper portions thereof.

A particular operation undertaken for which neither a conventional stepladder nor extension ladder is very suitable is in gaining access for trimming large decorative shrubs, the tops of which can usually not be reached by conventional stepladders, and in which because of bulk or girth and lack of a solid support, an extension ladder often is not appropriate to be employed to reach the upper domains of such a tree or bush.

Thus one is often faced with the multiple choice dilemma of reaching from a conventional stepladder with the inherent safety risks which this involves, or laying an extension ladder against the bush and having the ladder fall into the bush or roll off the bush because of overflexible or non-stable support to stabilize the extension ladder.

Various attempts to remedy this dilemma have employed generally jerry-mandered contraptions which comprise, for example, taking a extension ladder and temporarily attaching brackets thereto or lateral supports to stepladders. Various approaches to this have usually resulted in Rube Goldberg arrangements including brackets attached to extension ladders and modifications of stepladders and extension ladders that made them unsuitable for employment in the usual manner because of the additions, either temporary or permanent, of attachments to them which resulted in something entirely different from the usual stepladder and made them awkward to use.

In accordance with the present invention an easily moved mobile base is provided for temporarily securing retaining a conventional extension ladder to allow the extension ladder to be utilized in its usual manner and to reach heights in which the upper end of the extension ladder is not resting against the conventional upright wall and yet there is no permanent attachment to the unmodified extension ladder which would make it unsuitable for its normal intended use and/or awkward to move about.

The ladder support of the present invention temporarily retains the base of the lower section of the usual extension ladder and provides intermediate support so that the ladder may be used in a tilted upright position without the necessity of resting against a wall or providing any attached braces, legs, or lateral supports. In this manner, one can utilize the conventional extension ladder as a stepladder. It is particularly useful for trimming bulky bushes such as large decorative evergreens.

2. Prior Art

The closest prior art references of which the Applicant is aware are as follows:

U.S. Pat. No. 5,454,446—Zelikovitz shows a ladder with a lateral support secured to the bottom of the lower section and foldable lateral supports angling out from the top portion of the lower section of the ladder. It has the spreader arm 30 similar to a conventional step-ladder. The lateral supports are indicated at 45 and the base attachment at 40 This is essentially a permanently constructed combination extension ladder/stepladder and does not provide a separate independent stand or support in which to place unmodified extension ladder for use in a particular situation as is possible with the development of this invention.

U.S. Pat. No. 4,798,262—Margolies discloses in effect a tripodal supported stepladder in order to increase lateral stability.

Others references which generally illustrate the state of the art in this area include stabilizer bars or foldable support features and lateral support features for extension ladders are as follows: U.S. Pat. No. 1,496,201—Baxter, U.S. Pat. No. 3,059,723—Shore, U.S. Pat. No. 3,618,703—Wilke, U.S. Pat. No. 4,519,477—Ralston, U.S. Pat. No. 4,723,629—Vanden Hoek et al, U.S. Pat. No. 5,086,876—Severson.

SUMMARY OF THE INVENTION

In accordance with the present invention an adjustable base support for an extension ladder is provided. It has extending lateral feet as supports for an inclined frame which supports a conventional extension stepladder slanted in an upright position in such a manner that is not necessary to support the upper portions of the rails of the ladder against a vertical surface as is conventionally the case. The base is also adjustable so it may be used on terrain which is not perfectly level. It is physically anchored at its base to a support leg running perpendicularly to the supports. The base holding the lateral support also carries a receptacle in which the base of the lower portion of the extension ladder is retained to prevent the ladder from moving either laterally, or forward and backwards, so that the bases of the extension ladder are firmly anchored in place, and yet have the ability to tilt appropriately.

There is thus afforded a means to utilize the conventional extension ladder in areas which will not support the upper reaches of such a ladder against a wall as is normally done and required.

The device of the present invention is extremely useful in trimming ornamental bushes of up to two or three stories or more in height which because of their lateral bulk provide no solid support for an ordinary extension ladder to be supported to reach the upper reaches of such bushes.

In accordance with the present invention a ladder support which enables an ordinary parallel rail extension ladder or at least one section of such extension ladder to be utilized, in effect, as a stepladder in cases where there is no vertical support available for leaning the upper ends of the rails against is provided.

The present invention comprises a base frame piece which generally runs perpendicular to the rails of the ladder and board. The base extends left and right and has terminal pieces that run perpendicular to the cross bar at each end and which have adjustable feet. Running perpendicular and intersecting the central portion of the cross bar is a support member which is parallel with the bottom rail but runs along around the upper end and is perpendicular to the base section.

Connected intermediately is the top portion of the adjustable support, a vertical support piece which is hinged to the cross member at one end, and to the cross member of the parallel.

At the top of the parallel rails is a support bar running perpendicular to the support piece and having lateral pieces at the end thereof which serve to prevent the ladder, which is placed on the support piece, from shifting left or right.

In addition, both ends of the device are provided with lateral pieces to prevent slippage to the left or right. The support member is readily adjustable in length by a pin and detent arrangement that allows one to adjust the incline of the ladder from vertical towards horizontal and yet it is still able to serve as a support piece.

BRIEF DESCRIPTION OF THE DRAWING

In the accompanying drawing which forms a part of the specification.

ILLUSTRATIVE SPECIFIC EMBODIMENT

Figure 1:
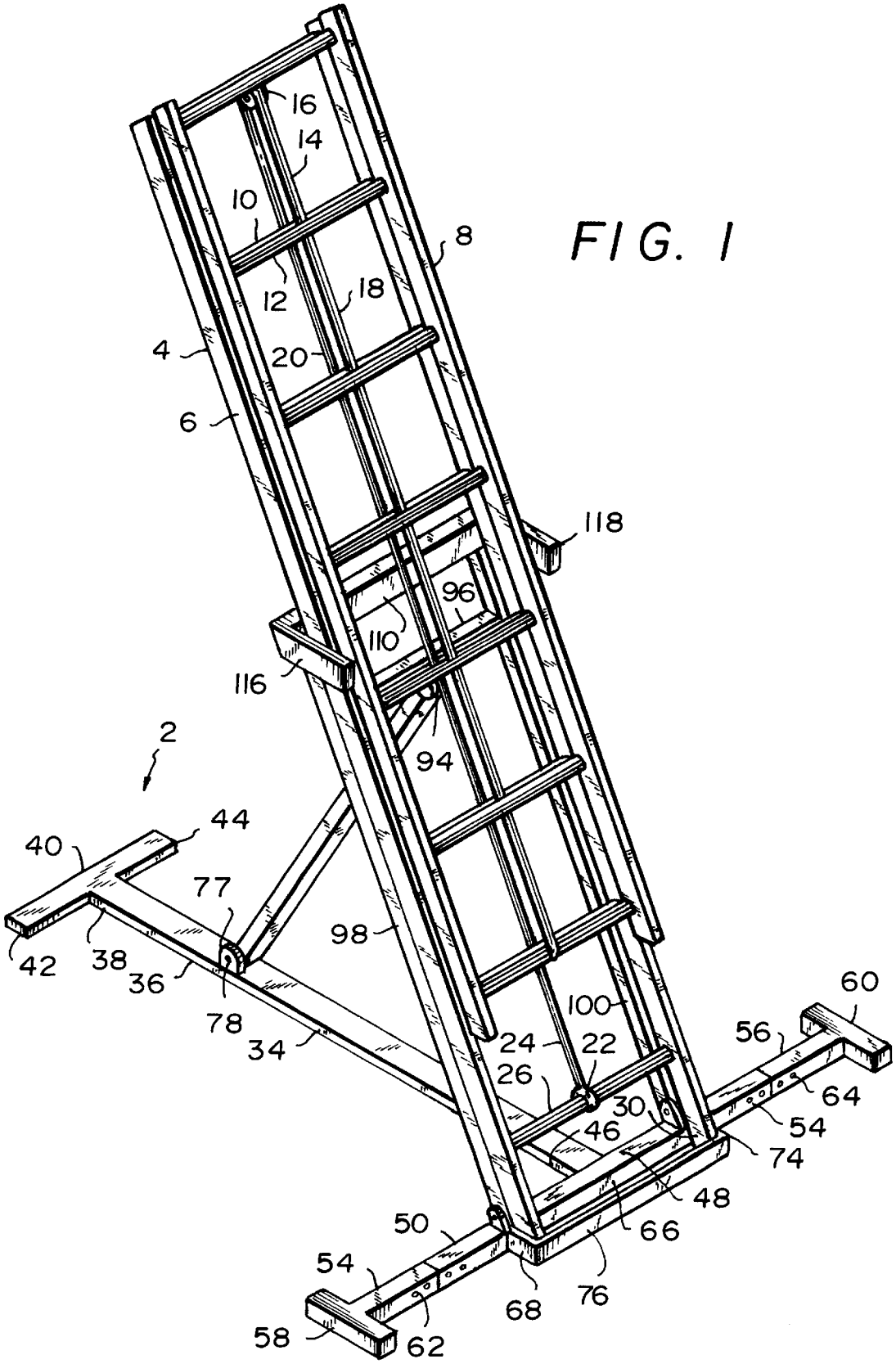
FIG. 1 is a perspective view showing the ladder support stand of the present invention with a partially extended extension ladder in place on it.
Figure 2:
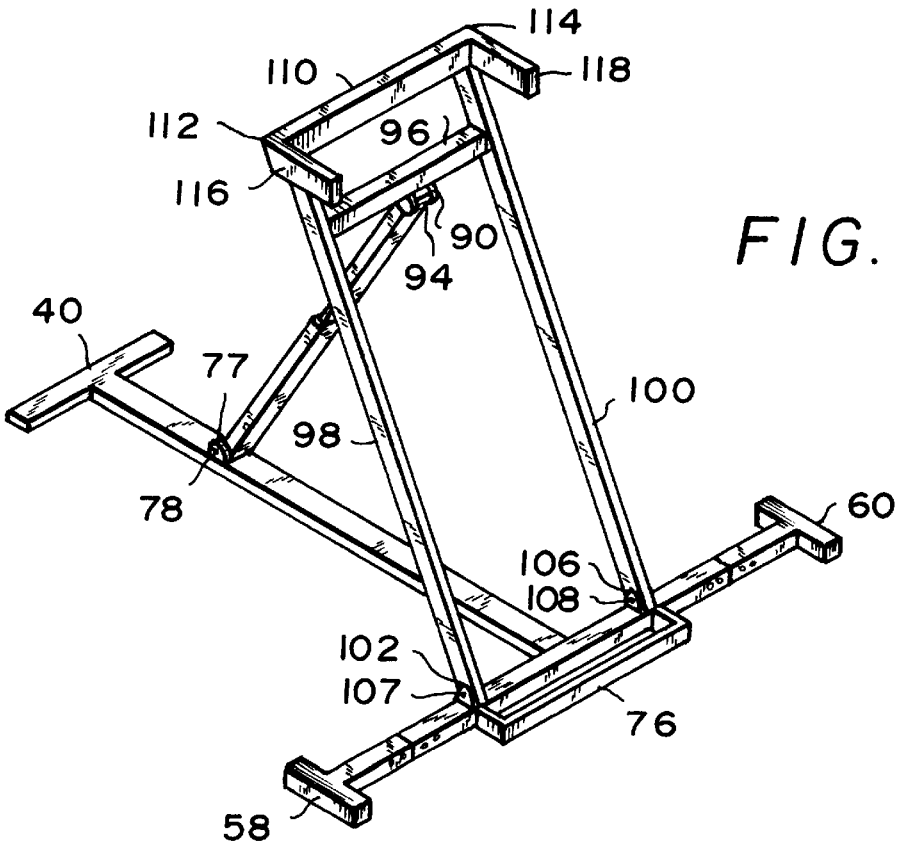
FIG. 2 is a perspective view of the support by itself.
Figure 3:
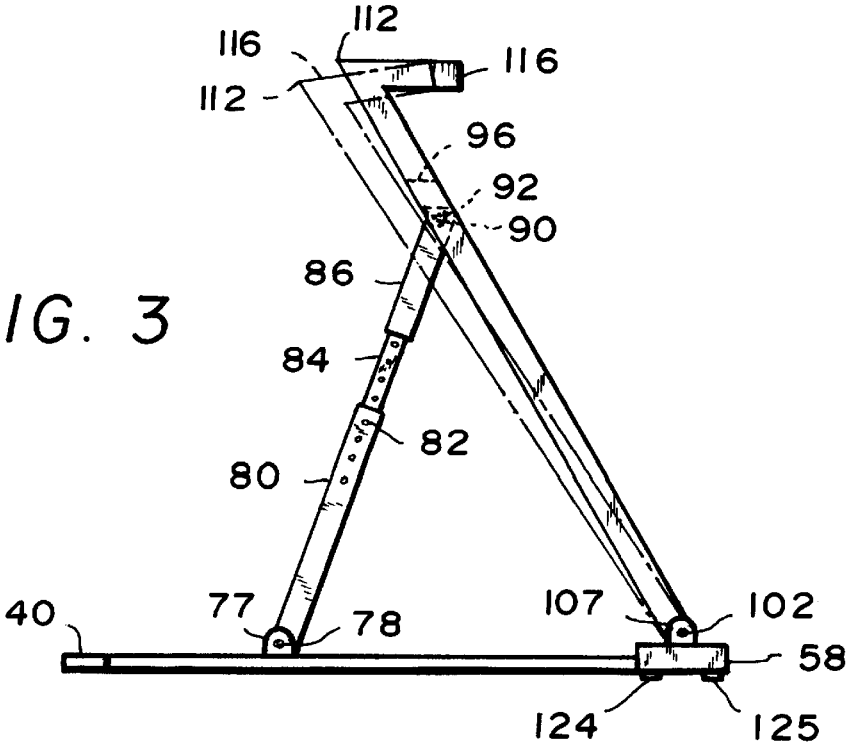
FIG. 3 is a side view of the stand with the tilt adjustment in phantom.
Figure 4:
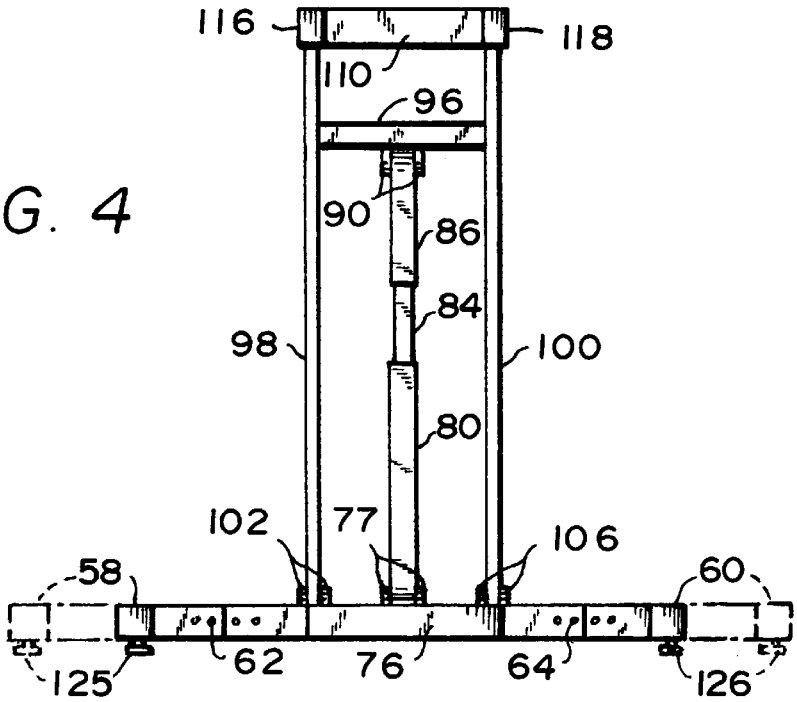
FIG. 4 is a front plain view of the support and showing the lateral extension of the base legs in phantom.
Figure 5:
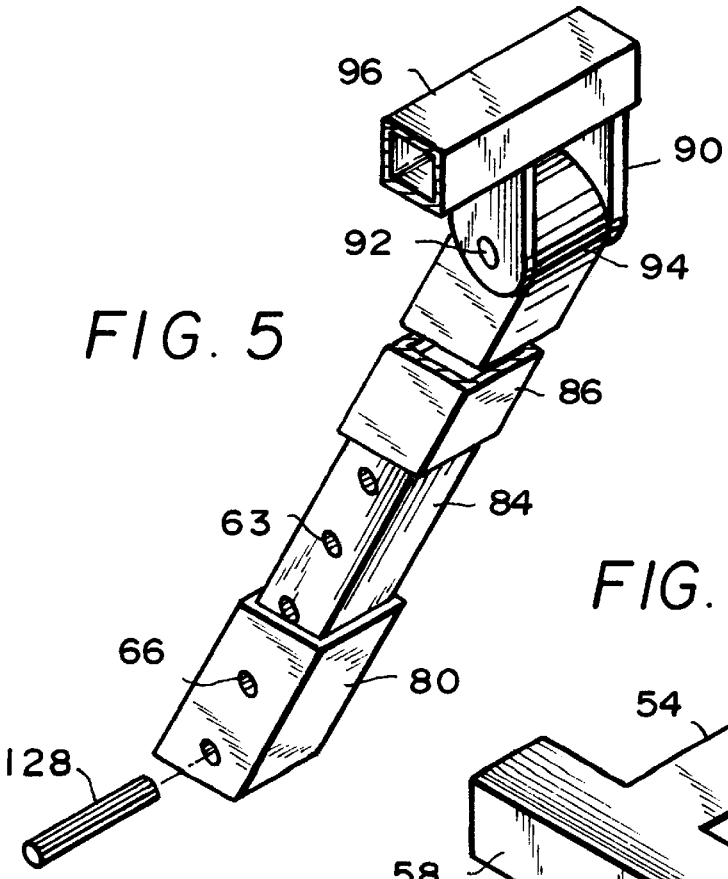
FIG. 5. is an enlarged perspective view of the adjustment details of the tilt leg support.

In the accompanying drawing which forms a part of this invention, the support structure of the present invention is indicated in general by the numeral 2, being used to support the illustrated extension ladder 4.

The ladder 4 comprises the usual lower half 6 and extensible upper half 8 respectively. The lower half 6 has spaced apart rungs 10 and the upper half 8 has spaced apart rungs 12. A rope 14 comprising two sections 18 and 20 respectively is utilized to raise the upper ladder half 8 by pulling on the lower portion 24 of the rope 14 section 18 which passes through the pulley 16 thereby moving the rope section 18 upperwardly. The portion 24 of rope 14 is secured to the lowest rung 28 of ladder 18 by knot 29 and the lower end 24 of portion 25 of the rope 14 utilized is secured to the lower half 6 rung 26.

The ladder 4 is secured in the support structure 2 with the bases 28 and 30 of section 6 of the ladder 4 respectively retained in the retainer trough 76 which is fixed to the perpendicularly extending support base 34 having inner section, an intermediate section 36, and outer section 38 of the support base 34, terminating in cross member 40 having end portions 42 and 44.

Figure 6:
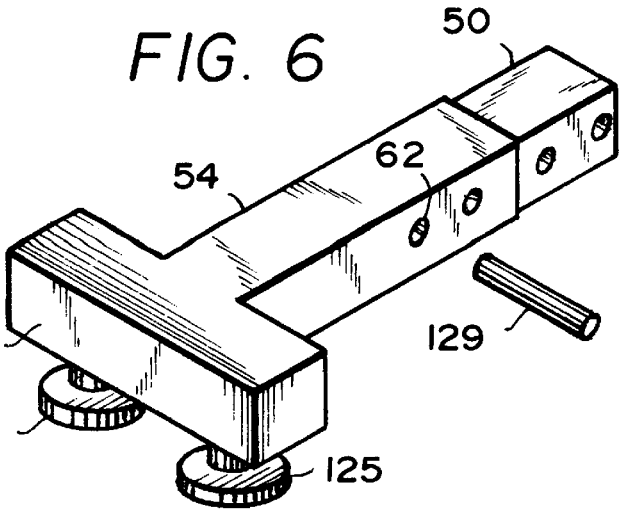
FIG. 6 is an enlarged perspective view of a base foot detail.

At the other end 46, of base 34 adjacent to the base of the ladder 4, a lateral base member 48 is attached to the perpendicular base 34. It has left and right extendible arms 50 and 52 respectively with adjustable extensions 54 and 56 which are adjustable by passing pins 128 through one of the apertures 62 and 64 respectively in the sections 50–54 and 52–56 which overlap in telescoping fashion as illustrated in FIG. 6.

The outer sections 54 and 56 have a parallel ends 58 and 60 to help stabilize the structure. These outer ends 58 and 60 are also provided with vertically adjustable feet 124, 125, 126, and 127.

The central portion 48 is provided with a base receptacle 66 having walls 68, 74, and 76. The bases 28 and 30 of the ladder base portion 8 are held in the receptacle 66.

A pair of upwardly standing ears 77 has a pivot pin 128 passing through an aperture 78 in the base of the adjustable upright arm 80. The arm 80 has apertures 66 therein matching aperture 63 in intermediate arm 84 for passing pin 82 for length adjustment.

The upper portion 86 of the upright arm 80 is pivotally secured to the bracket 90 on cross bracket 96 by pin 92 passing through the end 94 of portion 86. Bracket 90 is secured to the cross beam 96 running between the pivoted uprights 98 and 100. They are pivoted at their bases to ears 102 and 106 on the base 48 by means of pins 107 and 108.

The upper ends of pivoted uprights 98 and 100 support the horizontal bracket 110 with parallel arms 116 and 118 extending rearwardly to secure the ladder 4 against lateral movement. The ladder 4 rests on the cross member 110.

It is apparent that the present support provides a convenient adjustable retainer support to hold an extension ladder at various angles and to firmly secure the base thereof.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. An adjustable support adaptable to hold the lower ends of the rails of a separate extension ladder maintaining said ladder in a tilted upright position comprising:

retention means for removably holding the lower ends of the ladder rails;

a lateral base;

an adjustable arm extending outwardly from each end of the lateral base and having a transverse arm at the end of each adjustable arm for purposes of stability;

a support base extending transversely at a right angle from the lateral base at one end having a cross member at the other end;

a support structure for said ladder having a lower end pivotally connected to the lateral base and having an upper end comprising a substantially U-shaped bracket member for supporting said ladder; and, an adjustable support arm pivotally mounted to the support base at one end and pivotally mounted to the support structure at the other end.

2. An adjustable support adaptable to hold the lower ends of the rails of a separate extension ladder maintaining said ladder in a tilted upright position in accordance with claim 1 wherein:

the retention means comprises an elongated retainer trough attached to the lateral base at an intermediate point.

3. An adjustable support adaptable to hold the lower ends of the rails of a separate extension ladder maintaining said ladder in a tilted upright position in accordance with claim 1 comprising:

at least two elongated pins; and, wherein the lateral base and the adjustable arms comprise channel members having downwardly extending sides, a plurality of spaced transverse apertures in the sides, wherein the arms are telescopically mounted within the base channel and locked together with said pins engaging mating apertures.

4. An adjustable support adaptable to hold the lower ends of the rails of a separate extension ladder maintaining said ladder in a tilted upright position in accordance with claim 1 wherein:

the transverse arms each include a pair of downwardly extending feet, said feet being adjustable to compensate for uneven surfaces.

5. An adjustable support adaptable to hold the lower ends of the rails of a separate extension ladder maintaining said ladder in a tilted upright position in accordance with claim 1 wherein:

the pivotal support structure comprises a pair of parallel frame members each pivotally mounted to the lateral base at one end of the retainer trough and extending upwardly to engage the opposite rails of the ladder, a cross bracket fixedly mounted between the frame me members adjacent the upper end thereof and a substantially U-shaped member having a transverse member extending between the ends of the frame members and a pair of arms each extending outwardly at the ends of the bracket to hold the ladder therebetween.

6. An adjustable support adaptable to hold the lower ends of the rails of a separate extension ladder maintaining said ladder in a tilted upright position in accordance with claim 2 wherein:

the adjustable support arm comprises a hollow elongated lower portion having a plurality of spaced apertures extending along its length, said lower portion being pivotally connected to the base and the support arm including an intermediate portion having a plurality of spaced apertures, said intermediate portion being slidable within the lower portion, and a hollow upper portion having the intermediate portion extending outwardly therefrom at one end and being pivotally connected to the cross bracket.

7. An adjustable support adaptable to hold the lower ends of the rails of a separate extension ladder maintaining said ladder in a tilted upright position in accordance with claim 6 wherein:

the support arm includes a pin coupling the lower portion of the support arm and the intermediate portion by insertion of said pin through mating apertures.

* * * * *